US007648623B2

(12) United States Patent
Glass

(10) Patent No.: US 7,648,623 B2
(45) Date of Patent: Jan. 19, 2010

(54) PROTECTION OF REINFORCING STEEL

(76) Inventor: Gareth Glass, 3 Hillside, Lichfield, Staffordshire WS14 9DQ (GB)

( * ) Notice: Subject to any disclaimer, the term of this patent is extended or adjusted under 35 U.S.C. 154(b) by 420 days.

(21) Appl. No.: 11/631,722

(22) PCT Filed: Jul. 2, 2005

(86) PCT No.: PCT/GB2005/050100

§ 371 (c)(1),
(2), (4) Date: Jan. 5, 2007

(87) PCT Pub. No.: WO2006/003473

PCT Pub. Date: Jan. 12, 2006

(65) Prior Publication Data

US 2008/0073223 A1 Mar. 27, 2008

(30) Foreign Application Priority Data

Jul. 6, 2004 (GB) ..... 0415132.0

(51) Int. Cl.
*C23F 13/02* (2006.01)

(52) U.S. Cl. ..... 205/734; 205/740; 205/730; 205/732; 205/733; 204/196.21; 204/196.23; 204/196.24; 204/196.25; 204/196.36; 204/196.37

(58) Field of Classification Search ..... 204/196.21, 204/196.23, 196.24, 196.25, 196.36, 196.37; 205/730, 732, 733, 734, 740
See application file for complete search history.

(56) References Cited

U.S. PATENT DOCUMENTS 4,397,726 A * 8/1983 Schwert ..... 204/196.18
6,022,469 A 2/2000 Page
6,076,235 A 6/2000 Khokhar
6,165,346 A 12/2000 Whitmore
6,193,857 B1 2/2001 Davison et al.

(Continued)

FOREIGN PATENT DOCUMENTS

DE 4134232 4/1992

(Continued)

OTHER PUBLICATIONS

Cement & Concrete Composites vol. 24 (2002) pp. 159-167 (to Follow).

(Continued)

*Primary Examiner*—Bruce F Bell
(74) *Attorney, Agent, or Firm*—Davis & Bujold, P.L.L.C.

(57) ABSTRACT

This assembly provides a flexible method of attaching discrete sacrificial anodes to exposed steel in concrete construction to achieve an advantageous distribution of protection current. It comprises a base metal [1] that is less noble than steel, a conductor [6] connected to the base metal, a tying point [2] formed at least in part by the conductor, and a tie [4] that passes through the tying point [2] and around the steel [5]. The tie is used to physically tie the anode between steel bars prior to placing the concrete and in the process to electrically connect the anode to the steel. The tying point is open to facilitate adjusting the tie. The separation of the tie from an anode assembly with a tying point allows the tie to be selected during installation when the properties required by the application are known.

47 Claims, 6 Drawing Sheets

U.S. PATENT DOCUMENTS

| | | | |
|---|---|---|---|
| 6,217,742 | B1 | 4/2001 | Bennett |
| 6,572,760 | B2 | 6/2003 | Whitmore |
| 6,647,596 | B1 | 11/2003 | Caveney |
| 6,685,822 | B2 | 2/2004 | Buenfeld et al. |

FOREIGN PATENT DOCUMENTS

| | | |
|---|---|---|
| GB | 670482 | 4/1952 |
| JP | 59-140380 | 8/1984 |
| WO | WO 94/29496 | 12/1994 |
| WO | WO 00/26439 | 5/2000 |
| WO | 2005/106076 A1 | 11/2005 |
| WO | 2005/121760 A | 12/2005 |

OTHER PUBLICATIONS

Hassanein, A.M., G. K. Glass, N. R. Buenfeld, "Protection Current Distribution in Reinforced Concrete Cathodic Protection Systems", *Cement & Concrete Composites*, vol. 24, © (2002) pp. 159-167.

David Whitmore, Installation of Embedded Galvanic Anodes, American Concrete Institute.

* cited by examiner

PROTECTION OF REINFORCING STEEL

This application is a national stage completion of PCT/GB2005/050100 filed Jul. 2, 2005 which claims priority from British Application Serial No. 0415132.0 filed Jul. 6, 2004.

TECHNICAL FIELD

This invention relates to the protection of steel in concrete using sacrificial anodes and in particular to the connection of sacrificial anodes to steel in reinforced concrete construction prior to covering the steel with concrete or mortar.

BACKGROUND ART

Sacrificial cathodic protection is a technique that is used to limit the corrosion of steel in concrete. It involves connecting a base metal that is less noble than steel, such as a metal or alloy of zinc, aluminium or magnesium, to the steel. The base metal is consumed by anodic dissolution and in the process a current flows to the steel which becomes the protected cathode of the base metal—steel couple. U.S. Pat. No. 6,193,857 shows one arrangement that may be used to achieve this.

U.S. Pat. No. 6,685,822 discloses the use of sacrificial anodes in new concrete construction to protect steel in concrete. The sacrificial anode delivers current to the steel before the concrete has hardened to increase the tolerance of the reinforced concrete to aggressive chloride ion contamination.

Sacrificial anode systems exist as surface applied systems or embedded discrete systems. Surface applied anodes are large surface area anodes that deliver relatively low current densities of the order of 10 $mA/m^2$ when expressed per unit of anode area. Discrete anodes are individually distinct compact anodes that deliver relatively high current densities of the order of 50 to 250 $mA/m^2$ off the anode surface. They are placed in holes in the concrete or are attached to exposed steel in new construction or exposed steel at locations where patch repairs to the concrete are undertaken.

Discrete anodes are usually combined with an activating agent. The activating agent in contact with the base metal in a sacrificial anode assembly may prevent the anode from drying out or prevent the formation of insoluble products that restrict the dissolution of the base metal. U.S. Pat. No. 6,022,469 describes the use of KOH and LiOH to prevent the formation of insoluble zinc products that may otherwise result in zinc passivation. U.S. Pat. No. 6,165,346 describes the use of $LiNO_3$ as a deliquescent material to prevent the anode from drying out. U.S. Pat. No. 6,217,742 describes the use of combinations of $LiNO_3$ and LiBr to enhance the anode output.

In surface applied anode systems the source of protection current is distributed across the surface of the concrete. Current distribution is more complex with discrete sacrificial anodes. Cement & Concrete Composites vol. 24 (2002) pp. 159-167 investigates current distribution from a surface applied anode to embedded steel bars and notes that current distribution is affected by the boundary conditions, the concrete resistivity and the layout of the anode and the steel in the concrete.

The connection between the sacrificial anode and the steel reinforcement provides a path for electron conduction between the base metal and the steel. When the concrete is largely intact, the anode may be secured to the concrete surface or within the concrete cover and an electrical cable may be used to connect the anode to the steel. Such methods are also traditionally used to protect steel with other covering materials such as soil. The electrical cable may be connected to the steel using a clamp, clip or drilled and tapped hole. In addition, U.S. Pat. No. 6,572,760 describes a connection detail that involves obtaining contact between the anode and the reinforcing steel by impacting the anode against the steel in a suitably sized hole drilled through the concrete to the steel. U.S. Pat. No. 6,572,760 also describes a welded connection between the anode and the steel in a hole drilled through the concrete to the steel.

In some cases the concrete cover is not present and the steel is exposed. This occurs in new construction prior to casting the concrete and in existing construction when patch repairs are undertaken to corrosion damaged and spalled areas of a reinforced concrete structure prior to placing the cementitious patch repair material. In this case it is preferable to use the connection to secure the anode in place as well as make an electrical connection to the exposed steel. Tie wires have traditionally been used to secure and electrically connect the steel bars in reinforced concrete cathodic protection systems. The tie wire is typically a bare steel wire that is wrapped around the bars and tightened by twisting the ends of the wire together to secure and connect the bars together. WO 9429496 discloses an alkali activated sacrificial anode connected to a wire that is wrapped around the steel to form an electrical connection to the steel. U.S. Pat. No. 6,193,857 describes a method of connecting the anode to the steel which involves forming the anode around a section of a ductile metal conductor and wrapping the exposed ends of the ductile metal conductor around the steel and twisting the ends together to tighten the connection. Small loops are provided at the ends of the long ductile metal conductors that may be used by a twisting tool to tighten the connection.

Current practice is to tie the anodes directly on the exposed steel bars prior to casting the concrete. This practice is promoted by the existing inflexible connection detail. However, it is shown in Example 1 later in this document that tying the anodes directly on the steel results in poor distribution of the protection current. This invention discloses an advantageous method of connecting discrete sacrificial anodes to the steel in concrete in situations where the steel bars are exposed such as in new construction and at areas where patches of damaged concrete have been removed.

DISCLOSURE OF INVENTION

Technical Problem

Existing practice for attaching discrete sacrificial anodes to exposed steel bars in reinforced concrete construction is to tie the anodes directly on the exposed steel prior to placing the concrete or repair mortar. Reasons for this include a limited understanding of the magnitude of the effect that the anode-steel arrangement has on the distribution of the protection current, the use of anodes with fixed length tie wires on structures with widely varying steel reinforcement geometry and the need to withstand the forces imposed on the anode-steel connection during concrete placement or repair mortar application. These forces include the physical placement of the concrete or cementitious repair material and the use of compaction tools such as poker vibrators in the concrete mix. However locating the anodes close to the steel adversely affects the distribution of protection current (see Example 1). This invention provides a convenient method of locating the anodes between the steel bars.

Technical Solution

According to the present invention there is provided a method of protecting steel in concrete which comprises connecting a conductor with a tying point that is an opening such as a loop, hook, eye or hole to a base metal that is less noble than steel, and tying the tying point to the steel using a tie that is passed around the steel reinforcement and through the tying point. The tying point is formed at least in part by the conductor and it is open to facilitate changing the tie. The tie is electrically conductive such that it forms an electrical connection with the steel when it is wrapped around the steel and an electrical connection to the conductor when it is passed through the tying point. The tie is tightened to physically and electrically connect the assembly to the steel reinforcement. The tying point is preferably located close to the base metal. The base metal is preferably coupled to an activating agent that makes the base metal suitable for use as a discrete anode in the sacrificial protection of reinforcing steel in concrete. The anode will preferably have more than one tying point and more than one tie to enable it to be held between reinforcing steel bars. The tie preferably has a locking mechanism that restrains its loosening once it has been connected and tightened.

ADVANTAGEOUS EFFECTS

The assembly provides an adaptable method of attaching sacrificial anodes to exposed steel reinforcement while maintaining or improving the simplicity of making the connection when compared with other methods of connection. The flexibility arises from the separation of the tie from the rest of the anode assembly and providing the rest of the anode assembly with a tying point that both secures the tie and facilitates changing the tie. This allows the tie to be changed to suit the physical properties required by the application. This invention provides a convenient way of locating the anode between the steel bars to achieve an advantageous protection current distribution as the physical properties of the tie can be varied during installation to cope with the wide range of steel bar geometries encountered in concrete construction. Manufacture and packaging of the anode assembly is also simplified as the anode only needs to be attached to long ties when it is installed and the assembly may be supplied as an anode with a tying point and a separate tie.

DETAILED DESCRIPTION OF THE PREFERRED EMBODIMENTS

Figure 1:
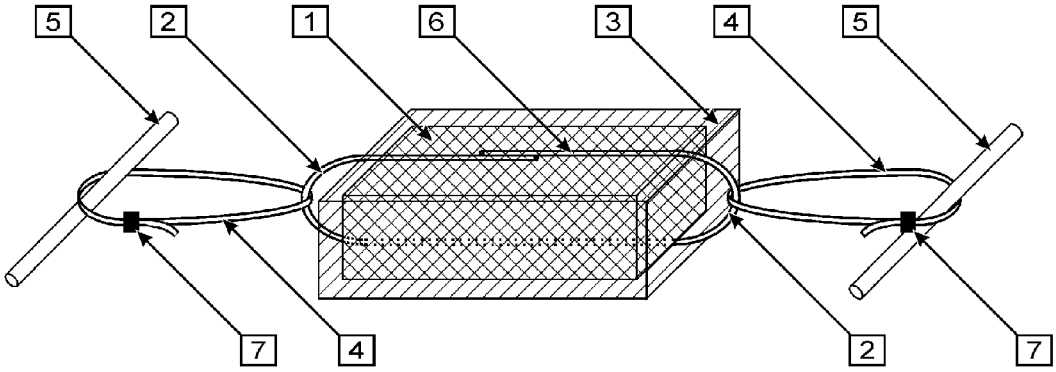
FIG. 1 shows one arrangement of the anode assembly connected between two reinforcing steel bars that utilises a wire loop to form a tying point.

One arrangement of the sacrificial anode assembly is given in FIG. 1. Referring to FIG. 1, the discrete sacrificial anode assembly comprises a base metal [1] that is less noble than steel, a conductor [6] connected to the base metal, a tying point [2] formed at least in part by the conductor, an activating medium [3] in contact with the base metal and a tie [4] which passes through the tying point [2] and around the steel [5].

The base metal [1] is a metal or alloy such as zinc, aluminium or magnesium or alloys thereof that will corrode in preference to steel when they are connected together. The activating medium [3] is a medium that contains an activating agent to assist the dissolution of the base metal in the concrete environment. Examples of activating agents include LiBr, KOH, and LiOH The tying point is an opening such as a hook, loop, eye or hole that is at least in part formed by a conductor in a way that facilitates the formation of an electrical connection between the conductor and a conductive tie that is passed through the fixing point. FIG. 1 shows an example of a conductor [6] that forms a loop [2] that acts as the tying point. The tying point is open to facilitate the use of ties with a range of physical properties and to facilitate adjusting the lengths of the tie ends extending from the tying point. The tying point [2] is preferably located close to the base metal [1] to maximise the adjustment that can be accommodated by varying the length of the tie [4].

The connection between the base metal and the conductor may be achieved by forming the base metal around a part of the conductor such as by casting the base metal around part of the conductor. This isolates the connection from the external environment. Other methods of connecting the conductor [6] to the base metal [1] include soldering, brazing and welding. This connection is preferably insulated from the external environment with an insulating coating such as an epoxy coating. The conductor that forms at least part of the tying point may be connected to the base metal through a short length of a second conductor.

The tie [4] is a separate bendable or flexible electrical conductor that passes through the tying point [2] and around the steel and is used to physically tie the assembly to the steel [5] and in the process make an electrical connection between the conductor and the steel. This allows electrons to move between the base metal and the steel. The tie has the property that it forms an electrical connection to the steel when it is wrapped around the steel. Examples of the tie [4] include a metallic cable tie and a bendable uncoated wire. The tie preferably has a locking mechanism [7] that restrains it from being loosened once it has been tightened. Examples of such a locking mechanism, present on metallic cable ties, are given in U.S. Pat. No. 6,076,235 and U.S. Pat. No. 6,647,596. Other locking mechanisms would also be suitable.

The separation of the tie from the rest of the assembly gives the anode assembly its flexibility. The strength and length of the tie can be selected when the anode is installed and the installation details are known. Stainless steel cable ties are available with strengths ranging from 500 to 2500 N and lengths ranging from 100 to 1000 mm. This variability in the properties of the tie means that this method of connection can accommodate the wide range of fixing arrangements arising in part from variations in steel bar spacing in concrete construction.

The conductor [6] and the tie [4] are made from a material that will conduct electrons. This material is preferably a metal, although in theory a material like carbon can also be used. The preferred metal is one that will be cathodically protected by the base metal [1] and will not induce dissimilar metal corrosion between the tie and the steel or between the tie and the conductor. Examples of suitable materials include steel and stainless steel.

To achieve an advantageous current distribution it is preferable to locate the base metal as far from the nearest steel surface as possible. This may be achieved by positioning the base metal midway between a pair of steel bars using ties as shown in FIG. 1. After the assembly has been tied between the steel, it would be embedded in a concrete or a cementitious repair material.

Figure 2:
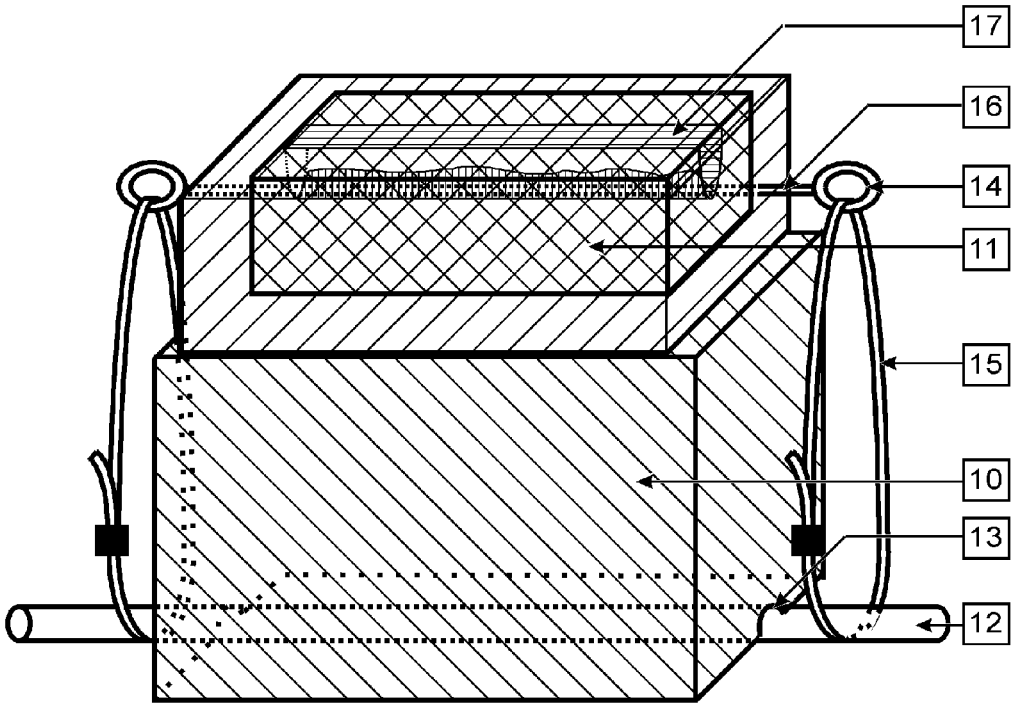
FIG. 2 shows another arrangement of the anode assembly connected to one reinforcing steel bar with a spacer between the anode and the steel to enhance current distribution.

FIG. 2 shows a second method of achieving an advantageous current distribution.

This is obtained by placing a porous spacer [10] between the base metal [11] and the steel [12] to which the anode is tied. This moves the anode away from the steel by the dimension of the spacer while still allowing some current to reach this location. The spacer preferably has a higher resistivity than the concrete that will be cast around the anode and the steel. The high resistivity of the spacer will discourage the flow of large currents directly to the closest steel under the spacer. The spacer is preferably shaped to facilitate its installation between the anode and the steel. The shape of the spacer could, for example, include an indentation [13] in which to locate the steel bar.

FIG. 2 also shows an assembly with an eye [14] that forms the tying point to hold the tie [15]. The conductor [16] with the eye is connected to the base metal in an indentation [17] in the base metal [11]. The indentation [17] is preferably filled with an insulating filler to provide further protection to the conductor—base metal connection.

Figure 3:
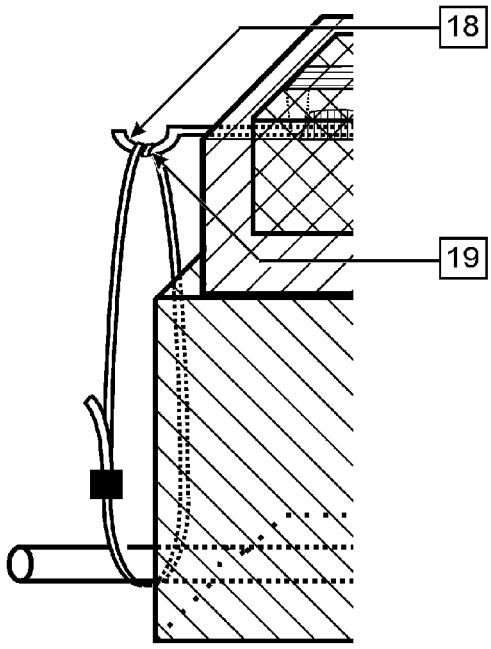
FIG. 3 shows a hook that forms a tying point to hold the tie that secures the anode to the steel.

FIG. 3 shows an assembly with a hook [18] that forms the tying point. It also shows the case where the tie [19] is passed through the tying point more than once to secure the tie to the tying point and improve the electrical connection between the tie and the portion of the conductor that forms the tying point. In the same way the tie may be wrapped around the steel more than once to improve the connection to the steel.

Specific features of this invention are illustrated with the following examples.

Example 1

Figure 4:
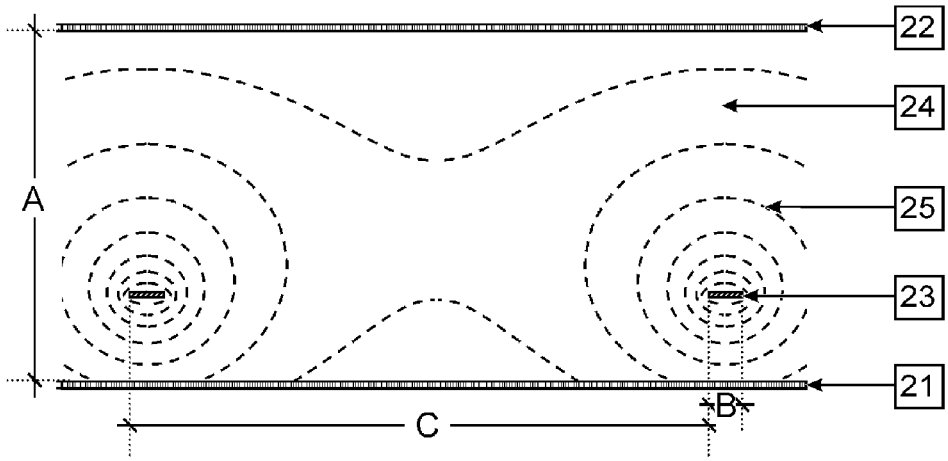
FIG. 4 shows a section through the arrangement of anodes and cathodes that was investigated in Example 1.

This example shows the effect of anode placement on current distribution in reinforced concrete. It is investigated using a mathematical model. FIG. 4 shows a section through the arrangement that was modelled. It consists of two parallel cathode plates ([21] and [22]) 200 mm apart with 30 mm wide anode strips [23] located between cathode plates at 334 mm intervals. These dimensions (200, 30 and 334 mm) are labelled A, B and C respectively in FIG. 4. A medium [24] with a resistivity of 200 ohm m that represents concrete fills the space between the anodes and the cathodes. The anode strips [23] are 2 mm thick and are all spaced off the cathode plate [21] by the same distance of concrete which varies between 10 and 99 mm in this example. The area of the anode is approximately one tenth that of the cathode. This arrangement is modelled on a 1 mm square grid using a finite difference method that is constrained by the need to conserve current at all points between the anode and cathode. This constraint is used to generate a pair of correction factors for each point on the grid to accelerate convergence of the model. The type of mathematical model is not critical to the findings and finite element or boundary element models may be used to obtain similar results. An example of the potential contours [25] resulting from the model when the anode is spaced 50 mm from the cathode is included in FIG. 4.

Figure 5:
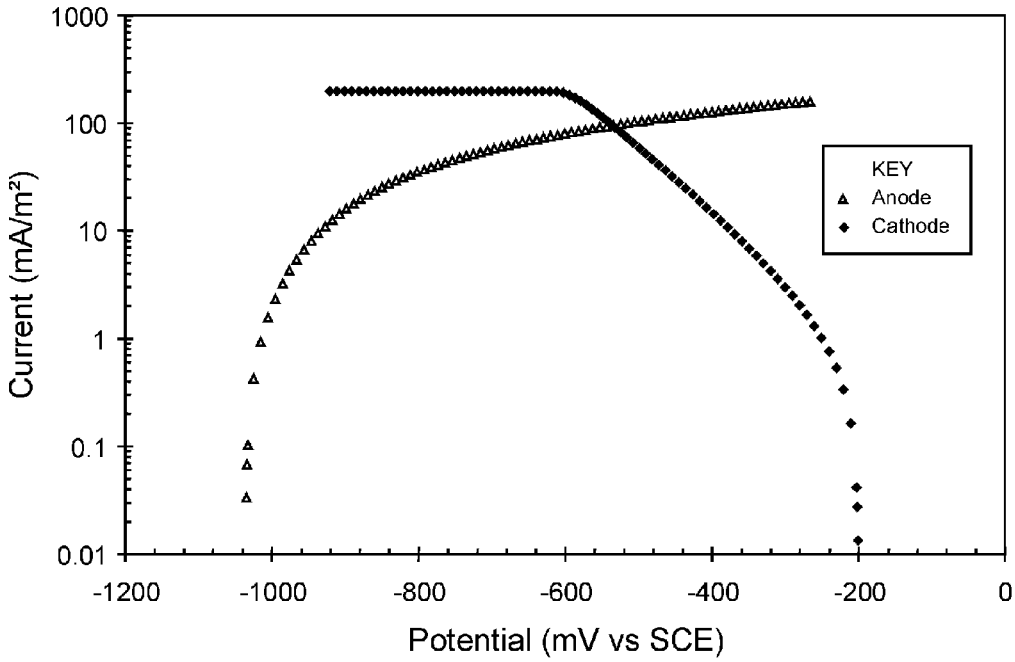
FIG. 5 shows the polarisation curves that were used to describe the anode and cathode boundary conditions in Example 1.

FIG. 5 shows two curves representing the potential-current relationship at the anode (also referred to as the anodic polarisation curve) and the cathode (also referred to as the cathodic polarisation curve) that are used to describe the boundary conditions at the anode and cathode respectively. All electrode potentials are given relative to the saturated calomel electrode (SCE).

The anodic polarisation curve in FIG. 5 represents the mixed potential-current relationship of an anodic and a cathodic reaction occurring locally on the anode. The anodic reaction on the anode is described by an equilibrium potential of −1114 mV, an exchange current density of 0.1 $mA/m^2$ at the equilibrium potential, an anodic Tafel slope of 60 mV and an approach resistance of 4 ohm $m^2$. The approach resistance may be viewed as the resistance to migration through a layer of anodic reaction products at the anode surface. The cathodic reaction on the anode is described by a limiting cathodic current of 1 $mA/m^2$. The combined effect of these two reactions on the anode gives an anode with an open-circuit local corrosion rate of 1 $mA/m^2$ and a corrosion potential of −1050 mV. This is used to model the behaviour of a zinc anode.

The cathodic polarisation curve in FIG. 5 represents the mixed potential-current relationship of an anodic and a cathodic reaction occurring locally on the cathode. The cathodic reaction on the cathode is described by an equilibrium potential of −33 mV, an exchange current density of 0.1 $mA/m^2$ at the equilibrium potential, a cathodic Tafel slope of 167 mV and a limiting current of 200 $mA/m^2$. The anodic reaction on the cathode is described by a limiting anodic current of 1 $mA/m^2$. The combined effect of these two reactions on the cathode gives a cathode with an open-circuit local corrosion rate of 1 $mA/m^2$ and a corrosion potential of −200 mV. This is used to model the behaviour of a steel cathode.

The boundary conditions described above at the anode and cathode are solved by iteration as part of the model. Similar results may be obtained by extracting the data from FIG. 5 and feeding it directly into the model.

Figure 6:
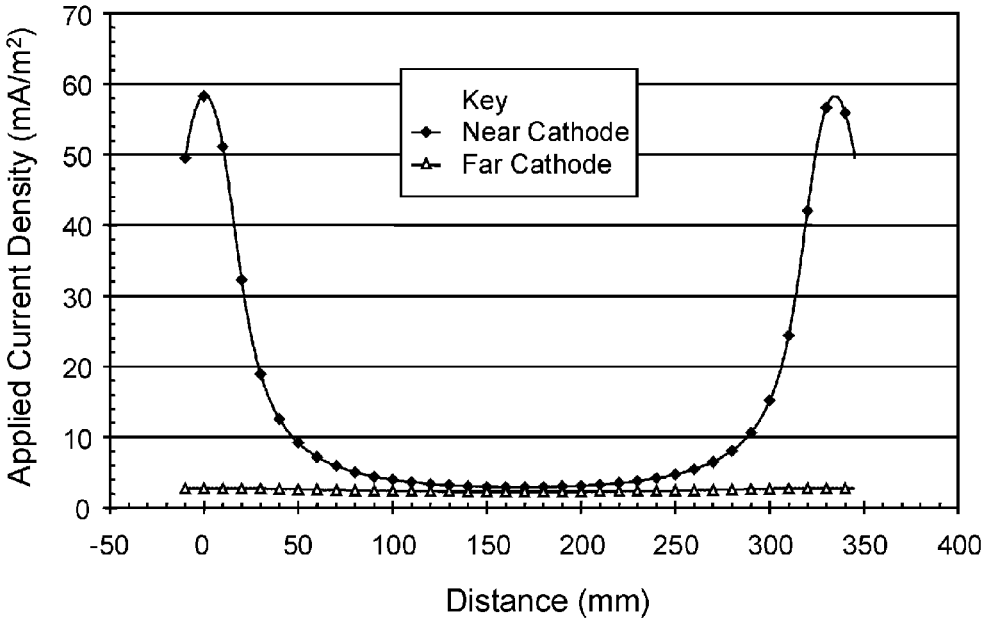
FIG. 6 shows the predicted current distribution to the cathodes when the anodes are located 10 mm from the closest cathode in Example 1.

FIG. 6 shows one set of results obtained by the model. It gives the current density applied to the near and far cathode plates as a function of distance across the cathode plate. The anode strip is spaced off the near cathode plate by 10 mm of concrete. The anodes are spaced off the cathode plates at positions 0 and 334 mm in FIG. 6. It is evident that when the anode is separated from the cathode by only 10 mm, the current density varies widely over the cathode. This represents a very inefficient use of the anode as some areas of the cathode will be overprotected while others may not receive enough current to achieve protection.

Figure 7:
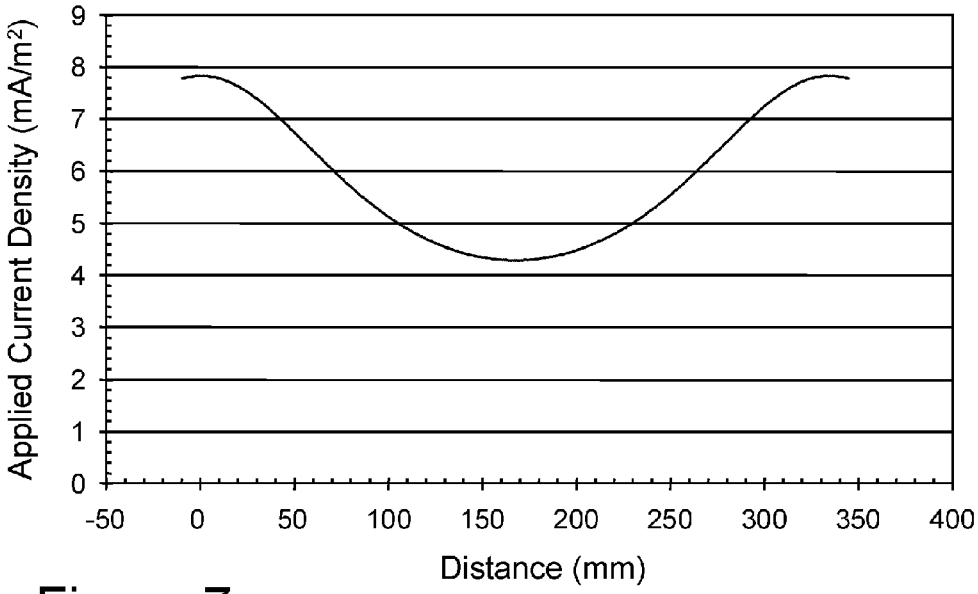
FIG. 7 shows the predicted current distribution to the cathodes when the anodes are located midway between the two cathodes in Example 1.

FIG. 7 shows the current density applied to the cathode plates when the anode strip is spaced off the nearest cathode plate by 99 mm of concrete. In this case the 2 mm thick anode strip is located midway between the cathode plates and the current distribution over the two cathode plates is identical. It is evident that, when the anode is separated from the cathode by 99 mm, the current density variation over the cathode is relatively small. This represents a much more efficient use of the anode than that given in FIG. 6.

Figure 8:
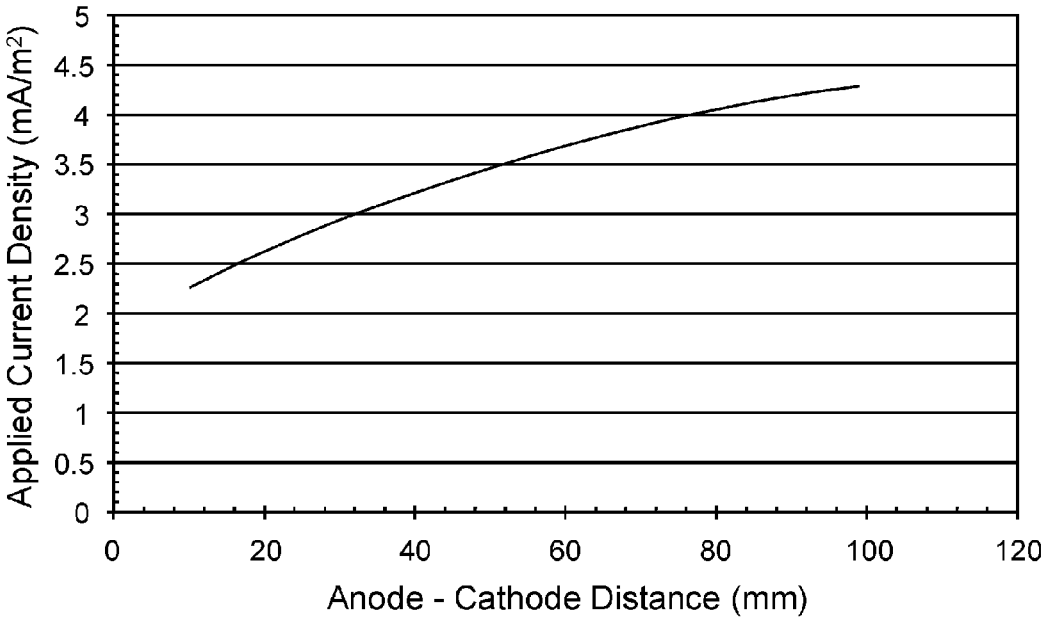
FIG. 8 shows the change in the minimum current density received by the cathode when the anode-cathode distance is varied from 10 to 99 mm in Example 1.

FIG. 8 shows the current density applied to the cathode at its furthest point from the anode plotted as a function of the distance separating the anode and the nearest cathode plate.

This location on the cathode receives the lowest current density. As the anode is moved away from the nearest cathode plate (10 to 99 mm), the current received at this location increases from 2.3 $mA/m^2$ to 4.3 $mA/m^2$. This represents a significant improvement in the protection afforded to this point on the cathode.

An analysis of FIG. 6 shows that, when the anode is spaced 10 mm off the cathode, only 28% of the cathode area will receive an applied current density greater than or equal to the minimum current density (4.3 $mA/m^2$) received by the cathode when the anode is located 99 mm off the cathode.

This example illustrates the significant advantages to be obtained by increasing the distance between discrete sacrificial anodes and protected steel in concrete.

Example 2

Figure 9:
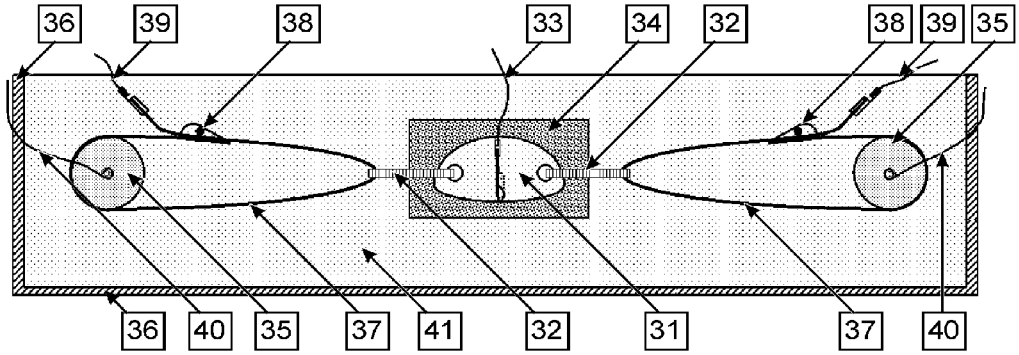
FIG. 9 shows the anode assembly arrangement that was used to monitor the anode output in Example 2.

A sacrificial anode assembly was produced and the output of the anode assembly to a pair of steel bars in concrete was monitored. FIG. 9 shows the arrangement that was used. Zinc in the shape of approximately half a sphere of diameter 46 mm and weight 223 g formed the base metal [31] of the anode. Two 4 mm diameter holes were drilled through the zinc at 5 mm from opposite edges of the flat surface of the zinc. An electrically insulating plastic cable tie was passed through each hole to form two insulating plastic loops [32] on opposite sides of the flat zinc surface. These insulated tying points are needed to facilitate electric current monitoring. Another hole 3 mm in diameter was drilled 5 mm from the edge of the flat surface of the zinc between the insulating plastic loops. A galvanised steel wire of diameter 1.5 mm was passed through the 3 mm hole and then twisted back on itself and pulled into the hole to create a tight and robust electrical connection to the zinc anode. The connection was insulated with silicone grease. An end of the galvanised wire was connected to a sheathed 1.5 $mm^2$ copper wire [33] by means of an insulated connector.

An ordinary Portland cement (OPC) mortar was made using a 3.4% LiBr solution in the place of clean water. The cement/fine sand/LiBr solution mix proportions expressed as a weight ratio were 1/2/0.6 respectively. The mortar [34] was cast around the zinc in a wooden mould that had internal dimensions of 65×65×50 mm. A portion of the plastic loops and the electrical cable extended beyond this mould. This produced an activated zinc sacrificial anode with dimensions of 65×65×50 mm with insulating plastic loops protruding from the opposing 65×50 mm faces and an electric cable connected to the zinc protruding from the top surface of the anode.

A wooden mould with internal dimensions of 100 mm high, 325 mm wide and 90 mm deep held two 11 mm diameter, 110 mm long ribbed steel bars [35] 220 mm apart and 50 mm above the base of the mould. This was achieved using four 11 mm holes drilled through the 100×325 mm faces of the mould. The ends of the bars protruded through these holes. A 100 mm high, 325 mm wide section of the mould [36] is shown in FIG. 9. The activated zinc sacrificial anode was located in the centre of the mould and tied to the steel bars [35] using two locking stainless steel cable ties 4.25 mm wide by 0.25 mm thick by 200 mm long [37]. The stainless steel cable ties passed through the plastic loops [32] and around the steel as shown in FIG. 9. The stainless steel cable ties [37] were tightened by hand and a locking mechanism [38] restrained the loosening of the ties.

Sheathed 1.5 $mm^2$ copper core electrical cables [39] were connected to the loose end of each of the stainless steel cable ties using female push on spade connectors crimped to the copper core of the cable. This connection was insulated with silicone grease. Additional electrical cables [40] were connected to the ends of the steel bars for monitoring purposes. These connections were made by drilling a 4 mm diameter hole to a depth of 10 mm into the end of the steel bar and inserting a length of exposed copper core at the end of the sheathed 1.5 $mm^2$ copper core electrical cable, together with a 3.5 mm metallic pop rivet, into the hole. The pop rivet was installed with a rivet gun to create an electrical connection between the steel and the copper wire. The connection was insulated with silicone grease.

The mould was filled with concrete [41]. The concrete mix consisted of OPC, aggregate and water. The aggregate was graded 0 to 20 mm all-in ballast supplied by 'Mix-it' and sourced from a builders merchant. The OPC/aggregate/water mix proportions expressed as a weight ratio were 25/100/13 which produced a general purpose concrete mix. The steel bars were exposed to the concrete for a length of 90 mm. All the electrical cables extended beyond the mould.

The resistance between each coated stainless steel cable tie and the steel bar to which it was tied was measured using a general purpose multimeter and the electrical cables connected to the steel and the stainless steel cable ties. The resistance values determined were approximately 0.3 ohms indicating that a good electrical connection could be obtained by this method.

Figure 10:
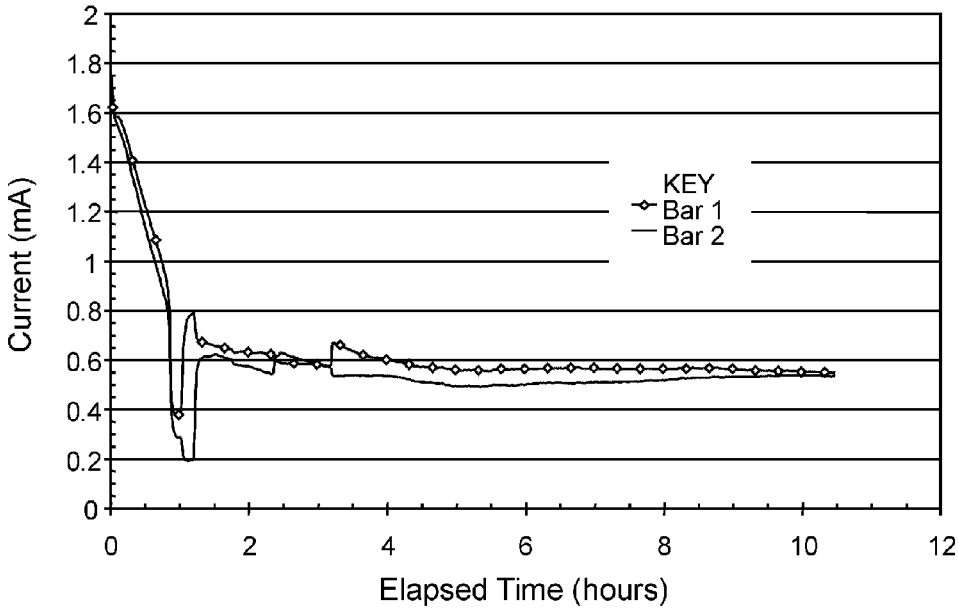
FIG. 10 shows a graph of the output of the anode assembly in Example 2.

The anode was connected to each of the steel bars through separate 10 ohms resistors using the electrical cables connected to the steel bars and the electrical cable connected to the anode. The voltage across the resistors was logged and converted to a current. The current to each of the steel bars labelled Bar 1 and Bar 2 is given in FIG. 10. The anode was generating more than 1 mA in this test which is equivalent to approximately 200 $mA/m^2$ of zinc surface area. The current was evenly distributed between the two bars. This level of current would be adequate to protect more than 0.1 $m^2$ of steel surface in many aggressive situations in reinforced concrete.

The invention claimed is:

1. A method of protecting steel in concrete, the method comprising the steps of:

connecting a conductor defining a tying point to a base metal less noble than steel;

passing a separate conductive tie through the tying point and around the steel;

tensioning the tie to make an electrical connection between the conductor and the steel; and covering the steel and the conductor and the base metal with one of concrete and a cementitious repair mortar.

2. The method according to claim 1, further comprising the step of coupling the base metal to an activating agent.

3. The method according to claim 1, further comprising the step of placing a porous resistive spacer between the base metal and the steel.

4. The method according to claim 3, further comprising the step of employing a spacer with a resistivity higher than a resistivity of one of the concrete or the cementitious mortar.

5. The method according to claim 1, further comprising the step of holding the base metal between steel bars.

6. The method according to claim 5, further comprising the step of connecting the base metal to the steel with at least one additional conductive tie.

7. The method according to claim 6, further comprising the step of connecting the base metal to the steel with at least one additional tying point.

8. The method according to claim 1, further comprising the step of connecting the base metal to the steel with one or more additional conductive ties.

9. The method according to claim 8, further comprising the step connecting the base metal to the steel with at least one additional tying point.

10. The method according to claim 1, further comprising the step of positioning the conductor in spaced relationship to the steel.

11. A method of protecting steel in concrete, the method comprising the steps of:

forming an anode from a base metal less noble than steel;

forming a porous spacer from a material having higher resistivity than one of concrete and cementitious repair material;

placing the porous spacer between the anode and each of one or more steel bars;

tying the anode to each of the one or more steel bars with a flexible conductive tie to make an electrical connection between the anode and each of the one or more steel bars; and covering the anode and the one or more steel bars with one of the concrete and cementitious repair material.

12. The method according to claim 11, further comprising the step of coupling the anode to an activating agent, and making the anode active in the one of the concrete and cementitious repair material.

13. The method according to claim 11, further comprising the steps of employing a conductor to define a tying point, connecting the conductor with the anode, passing a flexible conductive tie, separate from the conductor and the anode, thought the tying point and around the steel to connect the anode to the steel.

14. The method according to claim 13, further comprising the step of forming the tying point as one of a loop, hook, eye and hole.

15. An anode assembly for attachment to exposed steel bars prior to covering the steel bars with one of a cementitious repair mortar and concrete to protect steel in one of the cementitious repair mortar and the concrete, the anode assembly comprising:

a base metal less noble than steel;

a conductor electrically connected to the base metal;

a tying point; and a separate tie;

wherein the tying point is defined by the conductor;

the tying point is open to facilitate passing the separate tie through the tying point; and the length of the conductor between the tying point and the base metal is one of less than or equal to 75 mm.

16. The anode assembly according to claim 15, wherein the tying point is selected from the group consisting of a loop, a hook, an eye, and a hole.

17. The anode assembly according to claim 16, wherein the conductor comprises a metal that is cathodically protected by the base metal.

18. The anode assembly according to claim 15, wherein a distance between the tying point and the base metal is one of less than or equal to 50 mm.

19. The anode assembly according to claim 15, wherein a distance between the tying point and the base metal is one of less than or equal to 25 mm.

20. The anode assembly according to claim 15, wherein the conductor comprises a metal that is cathodically protected by the base metal.

21. The anode assembly according to claim 20, wherein the conductor comprises one of steel and stainless steel.

22. The anode assembly according to claim 15, wherein the base metal is coupled to an activating agent that maintains base metal activity in concrete.

23. An anode assembly for attachment to exposed steel bars prior to covering the steel bars with one of a cementitious repair mortar and concrete to protect steel in one of cementitious repair mortar and the concrete, the anode assembly comprising;

a base metal less noble than steel;

a conductor electrically connected to the base metal;

a tying point defined by die conductor; and a separate flexible, electrically conductive tie;

wherein the length of conductor between the tying point and the base metal is one of less than or equal to 75 mm; and the tie is adapted to pass through the tying point and about the steel and the tie is adapted to be tensioned into electrical contact with both the conductor and the steel.

24. The anode assembly according to claim 23, wherein the tie is adapted when tensioned to locate the anode assembly in a spaced relationship with respect to the steel.

25. The anode assembly according to claim 23, wherein the tying point is open allowing a length of tie ends, extending from the tying point, to be adjusted.

26. The anode assembly according to claim 25, wherein the tying point is selected from the group consisting of a loop, a hook, an eye, and a hole.

27. The anode assembly according to claim 26, wherein the conductor and the tie comprise a metal that is cathodically protected by the base metal.

28. The anode assembly according to claim 27, wherein the conductor and the tie comprise one of steel and stainless steel.

29. The anode assembly according to claim 27, wherein a separating distance between the tying point and the base metal is one of less than and equal to 50 mm.

30. The anode assembly according to claim 27, further including a porous resistive spacer placed between the base metal and the protected steel, a resistivity of the spacer is higher than a resistivity of one of the cementitious repair mortar and the concrete to which the anode assembly is exposed.

31. The anode assembly according to claim 27, wherein the tie has a self locking mechanism to tightened the tie and restrains the tie from being loosened.

32. The anode assembly according to claim 25, wherein the conductor and the tie comprise a metal that is cathodically protected by the base metal.

33. The anode assembly according to claim 25, wherein a separating distance between the tying point and the base metal is one of less than and equal to 75 mm.

34. The anode assembly according to claim 25, wherein a separating distance between the tying point and the base metal is one of less than and equal to 50 mm.

35. The anode assembly according to claim 25, further including a porous resistive spacer placed between the base metal and the protected steel, a the resistivity of the spacer is higher than a resistivity of one of the cementitious repair mortar and the concrete to which the anode assembly is exposed.

36. The anode assembly according to claim 25, wherein the tie has a self locking mechanism to tightened the tie and restrains the tie from being loosened.

37. The anode assembly according to claim 25, further comprising at least one additional tie.

38. The anode assembly according to claim 37, further comprising at least one additional tying point.

39. The anode assembly according to claim 23, wherein the tying point is selected from the group consisting of a loop, a hook, an eye, and a hole.

40. The anode assembly according to claim 23, wherein the conductor and the tie comprise a metal that is cathodically protected by the base metal.

41. The anode assembly according to claim 23, wherein a separating distance between the tying point and the base metal is one of less than and equal to 75 mm.

42. The anode assembly according to claim 23, wherein a separating distance between the tying point and the base metal is one of less than and equal to 50 mm.

43. The anode assembly according to claim 23, further including a porous resistive spacer placed between the base metal and the protected steel, a resistivity of the spacer is higher than a resistivity of one of the cementitious repair mortar and the concrete to which the anode assembly is exposed.

44. The anode assembly according to claim 23, wherein the tie has a self locking mechanism to tightened the tie and restrains the tie from being loosened.

45. The anode assembly according to claim 23, further comprising at least one additional tie.

46. The anode assembly according to claim 45, further comprising at least one additional tying point.

47. The anode assembly according to claim 23, wherein the base metal is coupled to an activating agent that maintains base metal activity in one of the cementitious repair mortar and the concrete.

* * * * *